US007963386B2

(12) United States Patent
Stauber

(10) Patent No.: US 7,963,386 B2
(45) Date of Patent: Jun. 21, 2011

(54) METHOD AND DEVICE FOR THE SELECTIVE PROCESSING OF PRINTED PRODUCTS

(75) Inventor: Hans Ulrich Stauber, Grut (CH)

(73) Assignee: Ferag AG, Hinwill (CH)

( * ) Notice: Subject to any disclaimer, the term of this patent is extended or adjusted under 35 U.S.C. 154(b) by 571 days.

(21) Appl. No.: 12/095,785

(22) PCT Filed: Nov. 22, 2006

(86) PCT No.: PCT/CH2006/000654
§ 371 (c)(1),
(2), (4) Date: Jun. 20, 2008

(87) PCT Pub. No.: WO2007/062534
PCT Pub. Date: Jul. 6, 2007

(65) Prior Publication Data

US 2008/0298641 A1 Dec. 4, 2008

(30) Foreign Application Priority Data

Dec. 2, 2005 (CH) ..... 1916/05

(51) Int. Cl.
*B65H 39/00* (2006.01)

(52) U.S. Cl. ..... 198/442; 198/348; 198/436; 198/644; 271/9.13

(58) Field of Classification Search ..... 198/348–349, 198/436–437, 442, 575, 644; 270/52.01; 271/9.13
See application file for complete search history.

(56) References Cited

U.S. PATENT DOCUMENTS

| | | | | |
|---|---|---|---|---|
| 4,552,349 | A | 11/1985 | Loos et al. | |
| 4,770,122 | A * | 9/1988 | Ichihashi et al. | 118/697 |
| 5,727,781 | A * | 3/1998 | Muller | 270/58.23 |
| 6,212,357 | B1 * | 4/2001 | Boehmer et al. | 399/401 |
| 6,516,239 | B1 * | 2/2003 | Madden et al. | 700/115 |
| 2005/0035521 | A1 * | 2/2005 | Stauber et al. | 270/58.23 |
| 2005/0065642 | A1 * | 3/2005 | Brixius et al. | 700/230 |

FOREIGN PATENT DOCUMENTS

| | | |
|---|---|---|
| DE | 2145270 | 3/1973 |
| EP | 0918720 B1 | 6/1999 |
| EP | 0918723 B1 | 6/1999 |
| EP | 1155992 A2 | 11/2001 |
| EP | 1277685 A1 | 1/2003 |
| EP | 1340704 A2 | 9/2003 |
| EP | 1445223 A1 | 8/2004 |
| EP | 1591395 A2 | 11/2005 |

* cited by examiner

*Primary Examiner* — Mark A Deuble
(74) *Attorney, Agent, or Firm* — Rankin, Hill & Clark LLP

(57) ABSTRACT

Printed products are optionally processed in a preliminary stage (1) and a follow-up stage (2). The printed products are fed in a printed-product stream. The printed products, for optionally processing in the preliminary stage (1), are directed optionally, by means of a diverter (5), to different conveying paths (6.1, 6.2, 6.3), on which processing arrangements (10, 11, 12) are set up. The printed products are processed in the processing arrangements and then conveyed on. In an intermediate region, in which the conveying paths (6.1, 6.2, 6.3) of the preliminary stage (1) run parallel to one another and one beside the other, different conveying paths (7.1, 7.2) of the follow-up stage (2) can optionally be connected to the conveying paths (6.1, 6.2, 6.3) of the preliminary stage (1). Processing arrangements (13, 14) for optionally processing the printed products are also set up on the various conveying paths of the follow-up stage (2). The apparatus allows optional processing in two stages which are completely independent of one another.

12 Claims, 2 Drawing Sheets

METHOD AND DEVICE FOR THE SELECTIVE PROCESSING OF PRINTED PRODUCTS

BACKGROUND OF THE INVENTION

The invention lies in the field of conveyor technology, and relates to a method and to a device according to the respective, independent patent claims. The method and the device according to the invention serve for the selective processing of printed products.

It is known to selectively process or not process printed products by way of conveying the printed products in a serial flow through a respective processing station, wherein the processing station is controlled such that it is active for the printed products to be processed, and passive for the printed products which are not to be processed. The disadvantage of such a processing lies in the fact that in the case of a relatively time-consuming processing, this determines the total performance and specifically independently of whether a larger or a smaller portion of the printed products is to be processed or not. The same applies essentially to other arrangements too, in which a fed flow of printed products is divided onto different conveyor paths, on which the printed products are processed in a different manner, or are not processed, if the differently processed and/or non-processed printed products are to be unified back again into a regular conveyor flow for a further processing, after this first processing stage. If this further processing is again a selective processing (further processing stage), then the reunified conveyor flow is divided up again, and after the processing, is unified again, if necessary. Thereby, it is the most time-consuming processing of the processing stages which determines the total performance of the whole device.

It is thus the object of the invention to provide a method and a device which permit at least the partial alleviation of the performance limitations briefly mentioned above, for the processing with at least two stages of selective processing which are independent of one another.

BRIEF SUMMARY OF THE INVENTION

The term "selective processing" is used in the following description of the invention for a plurality of processing steps, which are selectively carried out on printed products, wherein the selection is made according to products to be created (plurality of different processing devices for different processing steps) and/or according to the capacity of processing devices (plurality of essentially equal processing devices for the same processing steps). Thereby, a processing step of the selective processing may also consist of a plurality of part steps carried out one after the other, or a processing step may also be a "non-processing" which means the absence of a processing.

The term "stages of selective processing independent of one another" is used in the following description for consecutive groups of selectable processing steps, wherein the selection of a processing step in one stage (follow-up stage) is completely independent of the processing step which was selected for the same printed product in the preceding stage (preliminary stage). In other words, this means that the selection of the selectable processing step is a completely free one in each processing stage.

According to the method according to the invention, at least one feed flow of printed products is fed to a preliminary stage of selective processing. The printed products of the feed flow are then selectively led by way of a shunt in each case onto a selected conveyor path of a plurality of different conveyor paths, and on the selected conveyor path are fed to a selected processing step of a plurality of selectable processing steps and away therefrom after the processing. After the mentioned processing, the different conveyor paths of the preliminary stage run parallel to one another and next to one another through an intermediate region. In this intermediate region, different conveyor paths of a follow-up stage of selective processing may be selectively connected to the different conveyor paths of the preliminary stage, in a manner such that printed products from the different conveyor paths of the preliminary stage may be conveyed in a freely selectable manner onto the different conveyor paths of the follow-up stage. The printed products are again processed on the different conveyor paths of the follow-up stage, wherein the selectable processing steps are different from one another and a processing step is selected according to the products to be created and/or wherein the selectable processing steps are the same ones, and the selection is made according to the momentary capacity of the respective processing devices. Thereby, it is possible in both steps of the selective processing, to simultaneously process printed products and/or to convey them on conveyor paths running in a functionally parallel manner.

BRIEF DESCRIPTION OF THE DRAWINGS

The principle of the method and device according to the invention, as well as a preferred embodiment of the device, are described in detail by way of the following figures. Thereby, there are shown in.

DETAILED DESCRIPTION OF THE INVENTION

Figure 1:
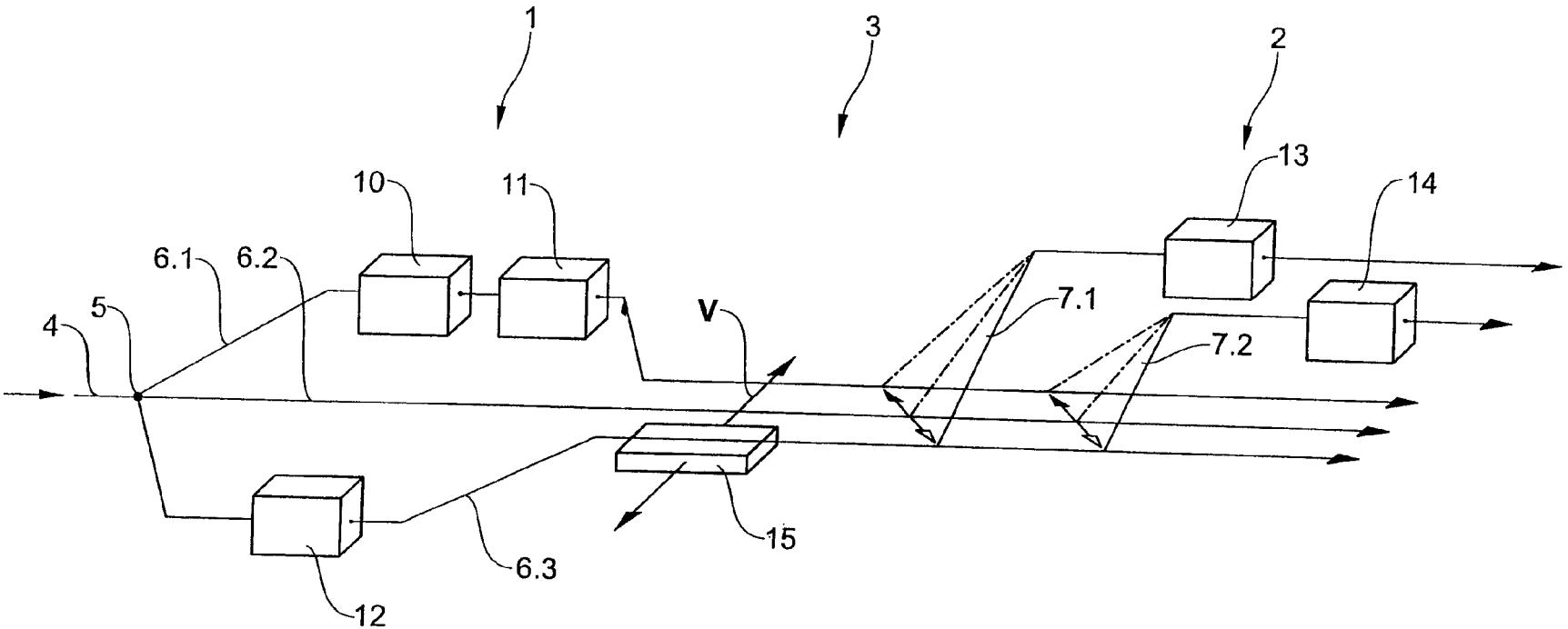
FIG. 1 a block schema for explaining the principle of the method and the device according to the invention.

FIG. 1 is a block schema which illustrates the principle of the method and the device according to the invention. In this schema, lines provided with arrows represent conveyor paths or conveyor devices, through which the printed products may be conveyed in the direction indicated by the arrows, essentially one after the other. The conveyor devices used for conveying are preferably revolving conveyor belts or revolving gripper conveyors, wherein in the schema of FIG. 1, in each case only the conveyor-active part of these conveyor devices is represented, but not the return belt section. In the schema according to FIG. 1, boxes represent processing steps or processing devices, wherein conveyor paths or conveyor devices are provided, in order to convey printed products along the conveyor paths to the processing devices, and away from them. Processing devices which are known per se may be applied as processing devices, and these are designed for carrying out a specified processing step on printed products which are fed one after the other.

The schema according to FIG. 1 shows a preliminary stage of selective processing, a follow-up stage 2 of selective processing, and an intermediate region 3 arranged between the preliminary stage 1 and the follow-up stage 2. The preliminary stage 1 at the entry side comprises at least one feed conveyor 4 in the manner known per se for feeding a printed product flow, and a shunt 5 by way of which the printed products of the feed flow may be selectively conveyed in each case onto one of the, for example, three different conveyor paths 6.1, 6.2, 6.3. The printed products on the conveyor paths 6.1, 6.2 and 6.3 are led to different processing steps or processing devices, wherein in an exemplary manner, a processing consisting of two part steps 10 and 11 is carried out on the conveyor path 6.1, no processing (non-processing) on the conveyor path 6.2, and a further processing 12 on the conveyor path 6.3. Thus, depending on the product to be manufactured, it is decided at the shunt 5 as to whether a fed printed product or a group of fed printed products are to run through processing steps 10 and 11 or processing step 12, or whether the printed product or the group of printed products are not to be processed.

According to the method according to the invention, the intermediate region 3, in which the different conveyor paths 6.1, 6.2 and 6.3 run parallel to one another and next to one another, and in which, for example, two different conveyor paths 7.1 and 7.2 of the follow-up stage 2 are selectively connectable in each case to one of the different conveyor paths 6.1, 6.2 or 6.3 of the preliminary stage, follows the selective processing of the preliminary stage 1. The different conveyor paths 7.1 and 7.2 of the follow-up stage 2, or respective conveyor devices lead the printed products again into processing steps or to processing devices 13 and 14 and away from these. Thereby, the processing 13 and 14 may be different from one another, and the section of the conveyor path or of the processing is again effected according to the products to be created. The processing 13 and 14 may, however, also be the same, and the selection is effected according to the capacity of the respective processing device.

It is possible without further ado, to connect a further intermediate region to the follow-up stage 2, by way of the different conveyor paths 7.1 and 7.2 of the follow-up stage 2 running parallel to one another and next to one another and by way of the different conveyor paths of the further follow-up stage being selectively connectable to the conveyor paths 7.1 and 7.2 of the follow-up stage 2.

Processing steps may also be carried out, or processing devices 15 arranged, in the intermediate region 3. If it is ensured that the printed products are not conveyed simultaneously on two or all three of the conveyor paths 6.1, 6.2 and 6.3 of the preliminary stage 1, the printed products having to be effectively processed in the intermediate region, then such a processing device may be arranged displaceable from one of the conveyor paths 6.1, 6.2 or 6.3 of the preliminary stage 1 to the other (double arrow V).

The feed flow of printed products, which is fed to the shunt 5 of the preliminary stage 1, is, for example, an imbricate flow which is conveyed on a conveyor belt. The shunt 5 is, for example, realized as a transfer location on which three gripper conveyors are arranged in parallel above the conveyor belt, and selectively grips printed products of the feed flow and conveys them onto the different conveyor paths 6.1, 6.2 and 6.3 of the preliminary stage 1. In the intermediate region 3, the conveyor paths 6.1, 6.2 and 6.3 of the preliminary stage 1 may be provided with conveyor belts and the different conveyor paths 7.1 and 7.2 of the follow-up stage 2 with gripper conveyors. However, is also possible, for example, to equip the different conveyor paths 6.1, 6.2 and 6.3 of the preliminary stage completely with gripper conveyors and to arrange the different conveyor paths 7.1 and 7.2 therebelow, and to provide them with pivotable conveyor belts, onto which the printed products may be selectively deposited by the gripper conveyors.

Figure 2:
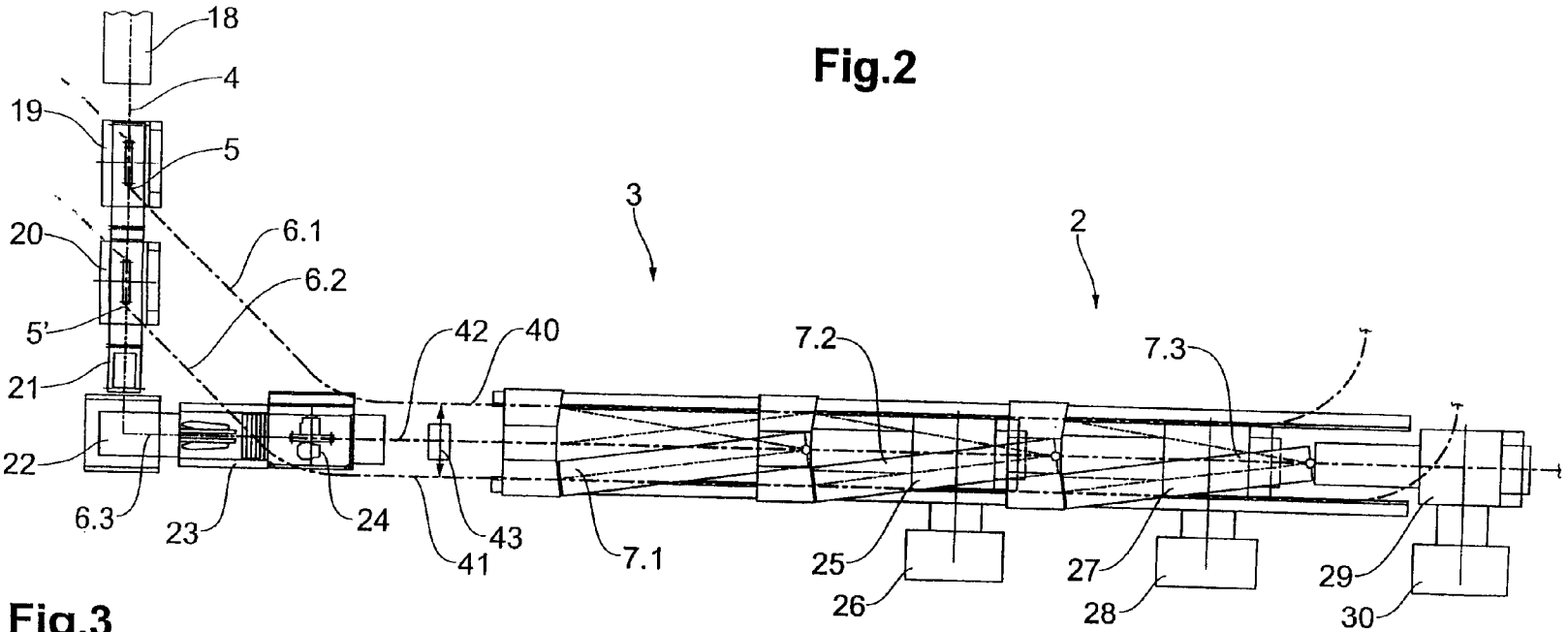
FIG. 2 a plan view of a preferred embodiment of the device according to the invention.
Figure 3:
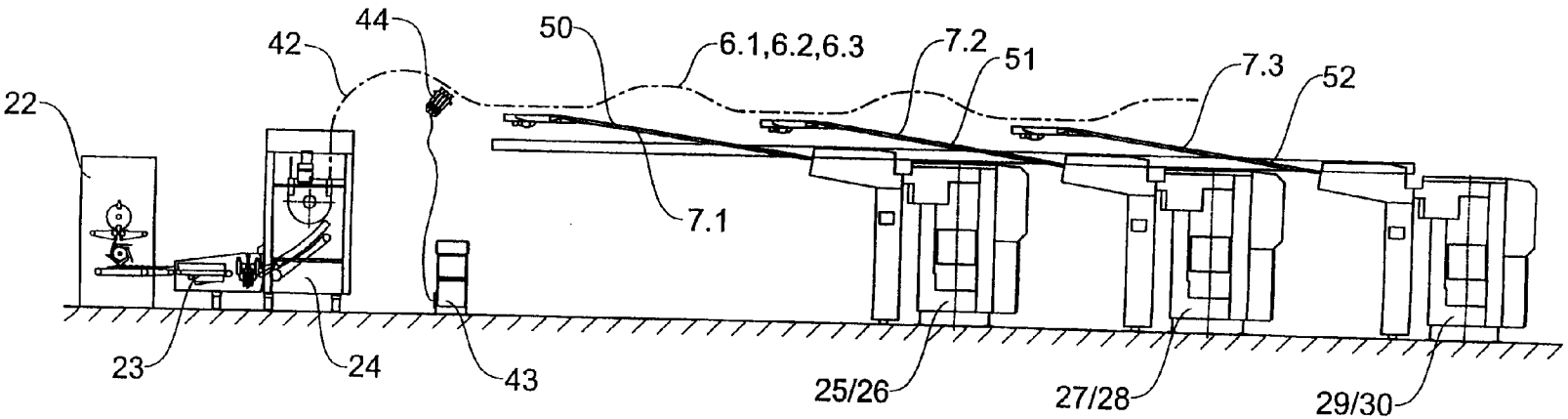
FIG. 3 the device according to FIG. 2, seen from the side.

As a plan view (FIG. 2) and seen from the side (FIG. 3), FIGS. 2 and 3 show a preferred embodiment of the device according to the invention. The same device parts and device regions are indicated with the same reference numerals. The represented device serves for carrying out the following, exemplary embodiment of the method according to the invention: the printed products are e.g. fed from a rotary printing machine 18 on a conveyor belt (feed conveyor 4, represented as a thin, dot-dashed line) and/or by way of gripper conveyors 40, 41 (represented as thicker dot-dashed lines) to the dispensing/transfer devices 19, 20. Thereby, the dispensing/transfer devices 19 and 20 assume the function of part shunts 5 and 5', in that printed products fed on the conveyor belt are selectively conveyed further, or are gripped by the grippers of the gripper conveyors 40, 41 and/or in that printed products which are supplied by the gripper conveyors 40 or 41 are selectively conveyed further and are deposited on the conveyor belt. By way of this, the printed products according to the free choice, go onto one of three conveyor paths 6.1, 6.2 or 6.3 of the preliminary stage 1 and are either singularised, folded, cut and then transferred onto a further gripper conveyor 42 (processing 21, 22, 23 and 24 on conveyor path 6.3) or not processed (conveyor path 6.1 and 6.2). In the intermediate region 3 which follows the preliminary stage 1, the printed products are conveyed further along the different conveyor paths 6.1, 6.2 and 6.3 of the preliminary stage 1 by way of gripper conveyors 40, 41, or 42, wherein these conveyor paths run parallel to one another and next to one another. Conveyor belts 50, 51 and 52 which are successively pivotable and which are each allocated on one of the conveyor paths 7.1, 7.2 or 7.3 of the follow-up stage 2, are arranged below the gripper conveyors 40, 41 or 42 of the conveyor paths 6.1, 6.2 and 6.3 of the preliminary stage 1, said conveyors running parallel and next to one another. Conveyor belts 50, 51 and 52 which may be pivoted one after another and which in each case are assigned to one of the conveyor paths 6.1, 6.2 or 6.3 of the follow-up stage 2, are arranged below the gripper conveyors 40, 41 and 42 of the conveyor paths 6.1, 6.2 and 6.3 of the preliminary stage 1, said conveyors running parallel and next to one another. The pivotable ends of these conveyor belts 50, 51, 52 are positionable below one of the conveyor paths 6.1, 6.2 or 6.3 depending on the pivoting, and convey the printed products running out from the preliminary stage 1, according to the capacity for example, to one of three stacking devices combined with a strapping device (processing devices 25/26, 27/28 or 29/30 of the follow-up stage 2). It is also possible to set the stacking/strapping devices to different formats and, thus, to either assign them to the processed (which means folded) products from the conveyor path 6.3, or to the non-processed products from the conveyor paths 6.1 or 6.2. Such a setting is possible without further ado also during operation.

The device represented in the FIGS. 2 and 3 is in particular suitable for the further processing of printed products which are manufactured from a rotary printing machine 18, wherein the device is connected in a direct manner on-line to the exit of this rotary printing machine and/or to a device (e.g. winding station, feeder) which is designed in order to produce a printed product flow (e.g. imbricate flow) from storage formations (windings, stacks, piles) of rotary printing machine products. The supplied rotary printing machine products are, for example, newspapers folded twice, which are either only stapled and strapped (follow-up stage 2 of selective processing) or are processed before the stacking and strapping, into multi-sided, smaller formatted printed products, by way of folding them an additional time, stapling them, if necessary, and cutting them in a manner such that the fold edges created in the rotary printing machine are cut away (preliminary stage 1 of the selective processing).

The processing stations on the conveyor path 6.3 of the preliminary stage 1 are a singularisation device 21 (singularisation wheel), a folding device 22, a cutting device 23 and a transfer device 24. The rotary printing machine products fed as an imbricate flow are singularised by the singularisation device. They are folded an additional time transversely to the second fold edge by way of the folding device 22, are cut transversely and/or parallel to the additional fold edge in the cutting device 23, and are taken over by further gripper conveyors 42 in the transfer device 24.

The gripper conveyors 40, 41 and 42 of the conveyor paths 6.1, 6.2 and 6.3 run in the intermediate region 3 parallel to one another and next to one another. An addressing device 43 is also arranged in the intermediate region 3, whose write head 44 is displaceable in the manner discussed further above, between the conveyor paths 6.1, 6.2 and 6.3.

The invention claimed is:

1. A method for the selective processing of printed products in a preliminary stage, and in a follow-up stage which follows the preliminary stage and which is independent of the preliminary stage, wherein the preliminary stage comprises a plurality of different conveyor paths which, in an intermediate region after the processing, run parallel to one another and side by side, and wherein the follow-up stage comprises a plurality of different conveyor paths, the method comprising the following steps:

supplying the printed products in at least one printed product flow to the preliminary stage;

selectively leading the printed products by way of a shunt onto one of the different conveyor paths of the preliminary stage;

subjecting the printed products to at least one processing step on the conveyor path, selectively connecting, in the intermediate region, the different conveyor paths of the follow-up stage to the different conveyor paths of the preliminary stage.

2. A method according to claim 1, wherein the processing steps of the selective processing of the preliminary stage and/or of the follow-up stage are processing steps which are different from one another and/or are an absence of a processing step, the method further comprising the step of selecting at least one of the processing steps according to the printed product to be manufactured.

3. A method according to claim 1, wherein the processing steps of the selective processing of the preliminary stage and/or of the follow-up stage are essentially the same, and the method further comprises the step of selecting at least one of the processing steps according to the processing capacity.

4. A method according to claim 1, wherein the printed products are rotary printing machine products manufactured from a rotary printing machine, wherein the selective processing of the preliminary stage is an additional folding and cutting or a non-processing, and wherein the selective processing of the follow-up stage is a stacking and strapping in a stacking/strapping device which has free capacity and/or is set to the respective format.

5. A device for the selective processing of printed products in a preliminary stage, and in a follow-up stage which follows the preliminary stage and which is independent of the preliminary stage, said device comprising:

at least one conveyor device for feeding at least one feed flow of printed products, a shunt for dividing the at least one feed flow onto in each case a selected one of a plurality of different conveyor paths of a preliminary stage of a selective processing, which are equipped with conveyor devices, and processing devices, to and away from which the different conveyor paths of the preliminary stage lead, wherein the different conveyor paths of the preliminary stage in an intermediate region after the processing devices are arranged parallel to one another and side by side, and wherein in this intermediate region, different conveyor paths of the follow-up stage of a selective processing, which are equipped with conveyor devices, are selectively connectable in each case to one of the different conveyor paths of the preliminary stage.

6. A device according to claim 5, wherein the conveyor devices are gripper conveyors or conveyor belts.

7. A device according to claim 5, wherein the processing devices, which are arranged in each case on one of the different conveyor paths of the preliminary stage or of the follow-up stage, are different from one another, and that the shunt and/or the selective connection of conveyor paths of the follow-up stage to conveyor paths of the preliminary stage may be controlled or set according to the products to be manufactured.

8. A device according to claim 5, wherein the processing devices, which are in each case arranged on one of the different conveyor paths of the preliminary stage or the follow-up stage, are essentially the same, and that the shunt and/or the selective connection of the conveyor paths of the follow-up stage to conveyor paths of the preliminary stage may be controlled or set according to the capacity of the processing devices.

9. A device according to claim 5, wherein the processing devices on a first conveyor path of the preliminary stage are a singularisation device, a folding device, a cutting device and a transfer device to a further gripper conveyor, whilst no processing devices are provided on further conveyor paths of the preliminary stage.

10. A device according to claim 9, wherein the conveyor devices for feeding the printed product flow are a conveyor belt and two gripper conveyors, and that two controllable dispensing/transfer devices are provided as part shunts.

11. A device according to claim 9, wherein the conveyor devices of the different conveyor paths of the follow-up stage, at least in the intermediate region are pivotable conveyor belts, and that the gripper conveyors of the different conveyor paths of the preliminary stage are arranged above the pivotable conveyor belts and may be controlled for the selective release of printed products.

12. A device according to claim 5, wherein the processing devices which are arranged on the conveyor paths of the follow-up stage, are stacking/strapping devices.

* * * * *